United States Patent [19]

Levensalor

[11] 4,111,461

[45] Sep. 5, 1978

[54] BARRIER COAT FOR GROUNDWOOD CARBONLESS COATED PAPER

[75] Inventor: George W. Levensalor, Millinocket, Me.

[73] Assignee: Great Northern Nekoosa Corporation, Stamford, Conn.

[21] Appl. No.: 751,205

[22] Filed: Dec. 16, 1976

[51] Int. Cl.[2] ..... B41L 1/36

[52] U.S. Cl. ..... 282/27.5; 427/146; 427/150; 427/261; 428/307; 428/327; 428/476; 428/537; 428/914

[58] Field of Search ..... 282/27.5; 428/914, 307, 428/327, 537, 511, 487, 476; 427/153, 146, 150, 261

[56] References Cited

U.S. PATENT DOCUMENTS

| | | | |
|---|---|---|---|
| 2,757,085 | 7/1956 | Paquin | 282/27.5 |
| 2,929,736 | 3/1960 | Miller et al. | 282/27.5 |
| 3,036,924 | 5/1962 | Newman | 428/487 |
| 3,432,327 | 3/1969 | Kan et al. | 428/914 |
| 3,506,471 | 4/1970 | Kimura et al. | 428/914 X |
| 3,682,680 | 8/1972 | Hayashi et al. | 428/511 X |

*Primary Examiner*—Thomas J. Herbert, Jr.

*Attorney, Agent, or Firm*—Hill, Gross, Simpson, Van Santen, Steadman, Chiara & Simpson

[57] ABSTRACT

Carbonless pressure sensitive copying sheet and a method of making the same, the sheet containing sufficient amounts of groundwood to normally cause yellowing when contacted with a color forming coating containing a color forming agent encapsulated in a polyamide resin. The yellowing characteristics are inhibited by providing a barrier layer which is coated directly on the base sheet, the barrier layer containing clay and other usual paper coating ingredients, together with an amount of an alkali metal sulfite sufficient to inhibit the yellowing tendencies. The color forming layer including the color forming agent encapsulated in the polyamide resin is applied over the barrier layer.

10 Claims, No Drawings

BARRIER COAT FOR GROUNDWOOD CARBONLESS COATED PAPER

BACKGROUND OF THE INVENTION

1. Field of the Invention

This invention is in the field of pressure sensitive carbonless copying sheets including a barrier layer between a groundwood containing base sheet and an overlying color forming layer, the barrier layer containing an alkali metal sulfite to prevent yellowing of the sheet.

2. Description of the Prior Art

The use of carbonless pressure sensitive copying sheets has become very widespread in recent years. Typically, such pressure sensitive sheets are sold as a manifold paper pack in which the top sheet consists of coated back (CB) paper having a micro-encapsulated coloring coating on its back, an intermediate sheet of paper which is coated front and back (CFB), having a color former reactive with the coloring coating on its front side and a color forming coating on the back, and a third sheet of coated front (CF) paper containing a color reactant on the front but no coating on the back.

The patented art describing carbonless pressure sensitive copying sheets is quite extensive and the following citations of such prior art are purely representative and by no means all inclusive.

Hemstock U.S. Pat. No. 3,223,546 describes sensitive sheets in which the coating consists of an encapsulated color forming organic material such as crystal violet lactone or benzoyl lueco methylene blue and the color reactant is a calcined kaoline clay which has been treated hydrothermally to transform it into an amorphous aluminum silicate.

Harbort U.S. Pat. No. 3,293,060 describes a pressure sensitive copy sheet in which the color reaction takes place between a spiro-dipran and an acid activated clay.

Amano et al. U.S. Pat. No. 3,330,722 describes a paper which is filled with clay and a water insoluble salt of cobalt, manganese, lead or mixtures thereof, such coating being capable of color reaction with various organic compounds.

Kan et al. U.S. Pat. No. 3,432,327 contains a very comprehensive disclosure of pressure sensitive copying sheets and combinations of materials which will react with each other to produce a colored mark in the presence of hydrophilic liquid.

Kimura et al. U.S. Pat. No. 3,506,471 provides a coloring agent in the microcapsules consisting of a fluorane derivative.

Brockett U.S. Pat. No. 3,516,845 describes paper coating compositions for pressure sensitive record sheets which contain kaolin, phenolic resins, and salts of metals such as zinc chloride. The addition of such salts is said to enhance the color activation by kaolin-phenolic resins and the face resistance of the colored form of the normally colorless color forming materials.

Watanabe U.S. Pat. No. 3,535,139 describes a color forming system in which one of the color formers is a derivative of a polyhydric phenol substantially insoluble in water and the other is an iron compound or vanadium compound.

Kimura et al. U.S. Pat. No. 3,551,181 describes a pressure sensitive copying paper in which the rupturable microcapsules contain an oil in which a phthalein compound is dissolved.

Philips U.S. Pat. No. 3,558,341 describes encapsulated color formers in which the effective ingredients are symmetrical N' disubstituted dithiooxamides.

Brockett U.S. Pat. No. 3,634,121 refers to a sensitized sheet record material containing fine mineral particles having absorbed thereon acid-reacting oil soluble polymeric materials such as phenolic polymers.

Miller et al. U.S. Pat. No. 3,663,256 describes a color forming system in which one of the color forming reactants is a phenolic resin containing at least 70% by weight of an oil soluble thermoplastic polymeric condensate of formaldehyde and at least one p-substituted phenol, the other color former being material such as crystal violet lactone.

Hayashi et al. U.S. Pat. No. 3,682,680 refers to a clay coated sheet for pressure sensitive copying sheets, wherein undesirable color changes such as yellowing and decreased activity are prevented by incorporating an organic acid salt into the clay-coated layer thereof.

Of particular interest in regard to the present invention is Ruus U.S. Pat. No. 3,429,827, the disclsoure of which is incorporated herein by reference. This patent describes an improved manifold paper having microscopic pressure rupturable capsules on at least one surface thereof, each capsule shell consisting of a high molecular weight condensation polymer such as a polyamide. The preferred method for the manufacture of the encapsulated particles is to disperse or emulsify one reactant for the condensation polymer in a continuous phase containing the second reactant. The substance to be encapsulated, the color former, is also contained in the dispersed phase. The polycondensation polymer shell forms at the inner phase of the dispersed substance and encapsulates the material. A typical reaction to form the polyamide shell results from the condensation of a polyhydric alcohol with teraphthaloyl chloride and a polyalkylene amine.

It would be highly desirable, particularly for reasons of economy to use paper sheets in the manifold which contain significant amounts of groundwood. It has been found, however, that where a groundwood sheet is contacted with a color former which is encapsulated in polyamide microspheres, the sheet turns yellow as the coating dries. Presumably, this is due to excess amine present in the coating which reacts with the lignin of the groundwood sheet to cause a discoloration.

SUMMARY OF THE INVENTION

The present invention is based upon the discovery that a barrier layer containing significant amounts of an alkali metal sulfite will effectively isolate the groundwood paper from the CB coating so as to eliminate the yellowing which would otherwise occur. The alkali metal sulfite is included in a typical paper coating formulation containing clay and starch as their predominating ingredients. Such coating compositions may include the usual additives necessary or desirable to provide the proper rheology and other characteristics to the coating.

The alkali metal sulfite is preferably combined with an alkali metal bisulfite, the latter being used to buffer the coating and to prevent changes in pH and the viscosity. In a preferred form of the present invention, sodium sulfite is included in the range from 4.0 to 11.0 oven dry parts per 100 parts of clay, and sodium bisulfite is included in amounts of 2.0 to 5.0 oven dry parts per 100 parts of clay.

The other ingredients in the barrier coating are not involved in preventing the discoloration, but are added for purposes of securing an adequate coating mixture. Typical additives used in conjunction with the clay and starch are lubricants, dispersants, insolubilizers and surface sizing materials.

DESCRIPTION OF THE PREFERRED EMBODIMENTS

The improved barrier coating of the present invention can be provided on groundwood base stock in amounts depending upon the amount of groundwood present. Typically, 3 to 4 pounds of the barrier coating may be applied to a base stock having a basis weight of 30 pounds (500 sheets, each 25 by 38 inches).

Broadly speaking, the amount of alkali metal sulfite such as sodium sulfite is in the range of 4.0 to 11.0 parts per 100 parts of clay, on an oven dry basis. This amount of sodium sulfite can be combined with about 2.0 to 5.0 parts by weight of sodium bisulfite. In the preferred embodiment of the present invention, the amount of sodium sulfite added is 7.0 to 8.0 parts per 100 parts of clay, on an over dry basis, combined with 2.0 to 3.0 parts of sodium bisulfite.

The remainder of the coating composition, of course, depends upon the type of equipment used to apply the coating. Generally speaking, however, for every 100 parts by weight of clay on an oven dry basis, there will be 30 to 50 parts by weight of starch. The composition will normally include a lubricant such as calcium stearate ranging from about 0.5 to 2 parts per 100 parts of clay. Soda ash in amounts less than 1 part by weight can be added for pH control, and a dispersant such as sodium hexametaphosphate in amounts less than about 0.50 parts per 100 parts by weight of clay may also be employed. Insolubilizing resins such as melamine formaldehyde resins may be present in amounts of about 1 to 6 parts per 100 parts of clay. Surface sizing materials, typically styrene-maleic anhydride condensation products may be added in amounts up to about 2 parts per 100 parts of clay.

A particularly preferred specific composition coming within the scope of the present invention is given in the following table:

| Material | Oven Dry Parts |
|---|---|
| Clay | 100 |
| Starch | 40 |
| Lubricant | 1 |
| Soda Ash | 0.25 |
| Dispersant | 0.15 |
| Insolubilizer | 3.2 |
| Surface Size | 1 |
| Sodium Sulfite | 7.5 |
| Sodium Bisulfite | 2.5 |

In the absence of the barrier coating, apparently there is sufficient amine in the CB coating to react with the lignin of the groundwood sheet to turn the sheet a yellow color as the CB coating dries. The presence of the sodium sulfite on the groundwood surface apparently involves the amine to react with the sodium sulfite preferentially before the amine-lignin reaction has a chance to occur.

It is not feasible to add the sodium sulfite directly to the CB coating since the sulfite deactivates the CB capsules, by destroying their imaging ability. Adding sodium sulfite to the base stock furnish is also ineffective, probably because of poor retention of sodium sulfite in the furnish.

From the foregoing, it will be understood that the barrier layer of the present invention makes it possible to use paper sheets having a considerable groundwood content in carbonless paper manifolds.

Heretofore, such carbonless paper has not taken a significant share of the market because of its expense, frequently being priced about 40% higher than the conventional register bond-carbon interleaved products.

It is to be emphasized that the coating formulations and the type of equipment used are widely variable in accordance with the present invention. For example, some processors use flow coaters and others use blade coaters or air knives. The compositions of the present invention are, of course, suitable for use on any such coaters provided the coating formulation is suitably adjusted to be usable on such equipment.

The improvements of the present invention, of course can be used with any type of carbonless copying system sheets, including manifold sheets utilizing both single and dual initially colorless color forming systems capable of producing a colored mark on both sides of the sheet. Such manifold systems are described, for example, in Maalouf U.S. Pat. No. 3,981,523.

It should be evident that various modifications can be made to the described embodiments without departing from the scope of the present invention.

I claim as my invention:

1. In a method of providing a carbonless non-yellowing pressure sensitive copying sheet wherein a color forming agent encapsulated in a synthetic resin shell is applied as a coating to a base sheet containing amounts of groundwood sufficient to cause yellowing after being contacted with said coating, the improvement which comprises interposing a barrier layer between said base sheet and said coating, said barrier layer comprising clay and an alkali metal sulfite.

2. The method of claim 1 in which said synthetic resin shell is a polyamide containing excess amine.

3. The method of claim 1 in which said alkali metal sulfite is sodium sulfite.

4. The method of claim 1 in which said barrier layer contains both sodium sulfite and sodium bisulfite.

5. The method of claim 1 in which said barrier layer comprises clay and starch as the predominating ingredients, and minor amounts of a dispersant and sodium sulfite.

6. A coated substantially non-yellowing copying sheet including a base sheet containing sufficient amounts of groundwood to cause yellowing when contacted with a color forming coating containing a color forming agent encapsulated in a polyamide resin containing excess amine, a barrier layer coated directly on said base sheet, said barrier layer containing clay and an amount of an alkali metal sulfite sufficient to inhibit such yellowing, and a color forming layer over said barrier layer, said color forming layer including said color forming agent encapsulated in said polyamide resin.

7. The copying sheet of claim 6 in which said barrier layer contains from 4 to 11 parts by weight sodium sulfite to 100 parts by weight clay on an oven dry basis.

8. The copying sheet of claim 6 in which said alkali metal sulfite is sodium sulfite.

9. The copying sheet of claim 8 in which said barrier layer also includes sodium bisulfite.

10. The copying sheet of claim 9 in which said barrier layer also includes clay and starch.

* * * * *